US012429238B2

(12) United States Patent
Hong et al.

(10) Patent No.: US 12,429,238 B2
(45) Date of Patent: Sep. 30, 2025

(54) AIR HEATING APPARATUS

(71) Applicant: KYUNGDONG NAVIEN CO., LTD., Pyeongtaek-si (KR)

(72) Inventors: Jae Sung Hong, Seoul (KR); Kwang Jae Lim, Seoul (KR)

(73) Assignee: KYUNGDONG NAVIEN CO., LTD., Pyeongtaek-si (KR)

( * ) Notice: Subject to any disclaimer, the term of this patent is extended or adjusted under 35 U.S.C. 154(b) by 120 days.

(21) Appl. No.: 18/429,964

(22) Filed: Feb. 1, 2024

(65) Prior Publication Data

US 2024/0255163 A1 Aug. 1, 2024

(30) Foreign Application Priority Data

Feb. 1, 2023 (KR) ..... 10-2023-0013903
Aug. 31, 2023 (KR) ..... 10-2023-0115753

(51) Int. Cl.
*F24F 5/00* (2006.01)

(52) U.S. Cl.
CPC ..... *F24F 5/0096* (2013.01)

(58) Field of Classification Search
CPC . F24H 9/00; F24H 3/02; F24H 9/0005; F24H 9/0042; F24H 9/02; F24H 9/12; F24F 5/0096
USPC ..... 165/59; 126/101
See application file for complete search history.

(56) References Cited

U.S. PATENT DOCUMENTS 10,088,197 B2 * 10/2018 Hamagami ..... F24H 15/395
12,044,431 B2 * 7/2024 Martin, Sr. ..... F24F 13/20
2014/0311710 A1 * 10/2014 Dee ..... F24H 6/00 165/104.13
2018/0094827 A1 * 4/2018 Knight ..... F24F 11/30
2021/0072093 A1 * 3/2021 Park ..... G01K 1/143
2022/0178553 A1 * 6/2022 Park ..... F24D 19/1015
2022/0178554 A1 * 6/2022 Park ..... F24D 9/00
2022/0178623 A1 * 6/2022 Park ..... F28D 17/04
2024/0060654 A1 * 2/2024 Park ..... F24D 11/006
2024/0060682 A1 * 2/2024 Park ..... F24H 9/148
2024/0060683 A1 * 2/2024 Park ..... F24H 4/04
2024/0183586 A1 * 6/2024 Lee ..... F25B 30/02
2024/0219071 A1 * 7/2024 Hong ..... F24H 8/00
2024/0255163 A1 * 8/2024 Hong ..... F24F 5/0096
2024/0255181 A1 * 8/2024 Hong ..... F24H 9/02
2024/0255182 A1 * 8/2024 Park ..... F24D 3/1008
2024/0255184 A1 * 8/2024 Hong ..... F24H 15/395
2024/0255185 A1 * 8/2024 Hong ..... F24H 15/242
(Continued)

*Primary Examiner* — Claire E Rojohn, III
(74) *Attorney, Agent, or Firm* — Dinsmore & Shohl LLP; Yongsok Choi, Esq.

(57) ABSTRACT

An air heating apparatus includes an expansion tank that stores water, a water heating device that receives heat from combustion gas generated by a combustion reaction and heats the water, a heating heat exchanger that receives the water heated by the water heating device and conducts heat exchange between air to be released for heating and the water, a fan that supplies the air to the heating heat exchanger, and a case in which the water heating device, the expansion tank, the heating heat exchanger, and the fan are disposed. The case includes an outer box, a first partition wall that is coupled to the outer box and that extends in a reference direction perpendicular to an up-down direction to divide the inside of the outer box into a first partition space and a second partition space, and an air guide.

9 Claims, 11 Drawing Sheets

(56) References Cited

U.S. PATENT DOCUMENTS

| | | | | |
|---|---|---|---|---|
| 2025/0093051 | A1* | 3/2025 | Kim | F24F 1/24 |
| 2025/0093073 | A1* | 3/2025 | Hong | F24H 6/00 |

* cited by examiner

AIR HEATING APPARATUS

CROSS-REFERENCE TO RELATED APPLICATIONS

This application claims the benefit of priority to Korean Patent Application Nos. 10-2023-0013903 and 10-2023-0115753, filed in the Korean Intellectual Property Office on Feb. 1, 2023 and Aug. 31, 2023, respectively, the entire contents of which are incorporated herein by reference.

TECHNICAL FIELD

The present disclosure relates to an air heating apparatus for heating.

BACKGROUND

In North American homes, heating may be performed by supplying heated air through a duct connected to each room. A device called a gas furnace is usually used to heat the air. The heating may be supplied in such a manner that the gas furnace generates heat by burning fuel and transfers the heat to the air and the heated air is distributed to each room.

In general, by allowing high-temperature combustion gas generated by a combustion reaction in a burner to flow through a pipe included in a heat exchanger and allowing the air to flow around the pipe, the gas furnace conducts heat exchange between the air and the combustion gas in the heat exchanger and heats up the air.

The gas furnace may cause problems such as leakage of combustion gas and drying of air in a house. In order to compensate for the aforementioned problems with the gas furnace, it may be considered to apply a new type of furnace called a hydro furnace.

In general, by heating up water using high-temperature combustion gas generated by a combustion reaction in a burner, allowing the heated water to flow through a pipe of a heat exchanger, and allowing air to flow around the pipe using a fan, the hydro furnace conducts heat exchange between the water and the air and heats up the air.

However, the hydro furnace has a problem in that operating efficiency is deteriorated due to an air leak occurring in a process in which the fan blows out the air and delivers the air to the heat exchanger.

In addition, the hydro furnace has a problem in that there is no structure to guide the movement of the heat exchanger in an assembly process of the hydro furnace, which causes inconvenience when the heat exchanger is assembled and disassembled.

SUMMARY

The present disclosure has been made to solve the above-mentioned problems occurring in the prior art while advantages achieved by the prior art are maintained intact.

An aspect of the present disclosure provides an air heating apparatus for reducing leakage of air supplied by a fan.

Another aspect of the present disclosure provides an air heating apparatus for improving assembly performance of a heat exchanger.

The technical problems to be solved by the present disclosure are not limited to the aforementioned problems, and any other technical problems not mentioned herein will be clearly understood from the following description by those skilled in the art to which the present disclosure pertains.

According to an aspect of the present disclosure, an air heating apparatus includes an expansion tank that stores water, a water heating device that receives heat from combustion gas generated by a combustion reaction and heats the water, a heating heat exchanger that receives the water heated by the water heating device and conducts heat exchange between air to be released for heating and the water, a fan that supplies the air to the heating heat exchanger, and a case in which the water heating device, the expansion tank, the heating heat exchanger, and the fan are disposed. The case includes an outer box, a first partition wall that is coupled to the outer box and that extends in a reference direction perpendicular to an up-down direction to divide the inside of the outer box into a first partition space and a second partition space, and an air guide that is seated on an upper side of the first partition wall and fluidically connected with a communicating hole formed in the first partition wall and that extends upward. The first partition space is located above the second partition space. The heating heat exchanger is disposed above the air guide in the first partition space, and the fan is disposed in the second partition space below the air guide. A guide member is coupled to the outside of an upper end of the air guide to guide sliding of the heating heat exchanger in the reference direction.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
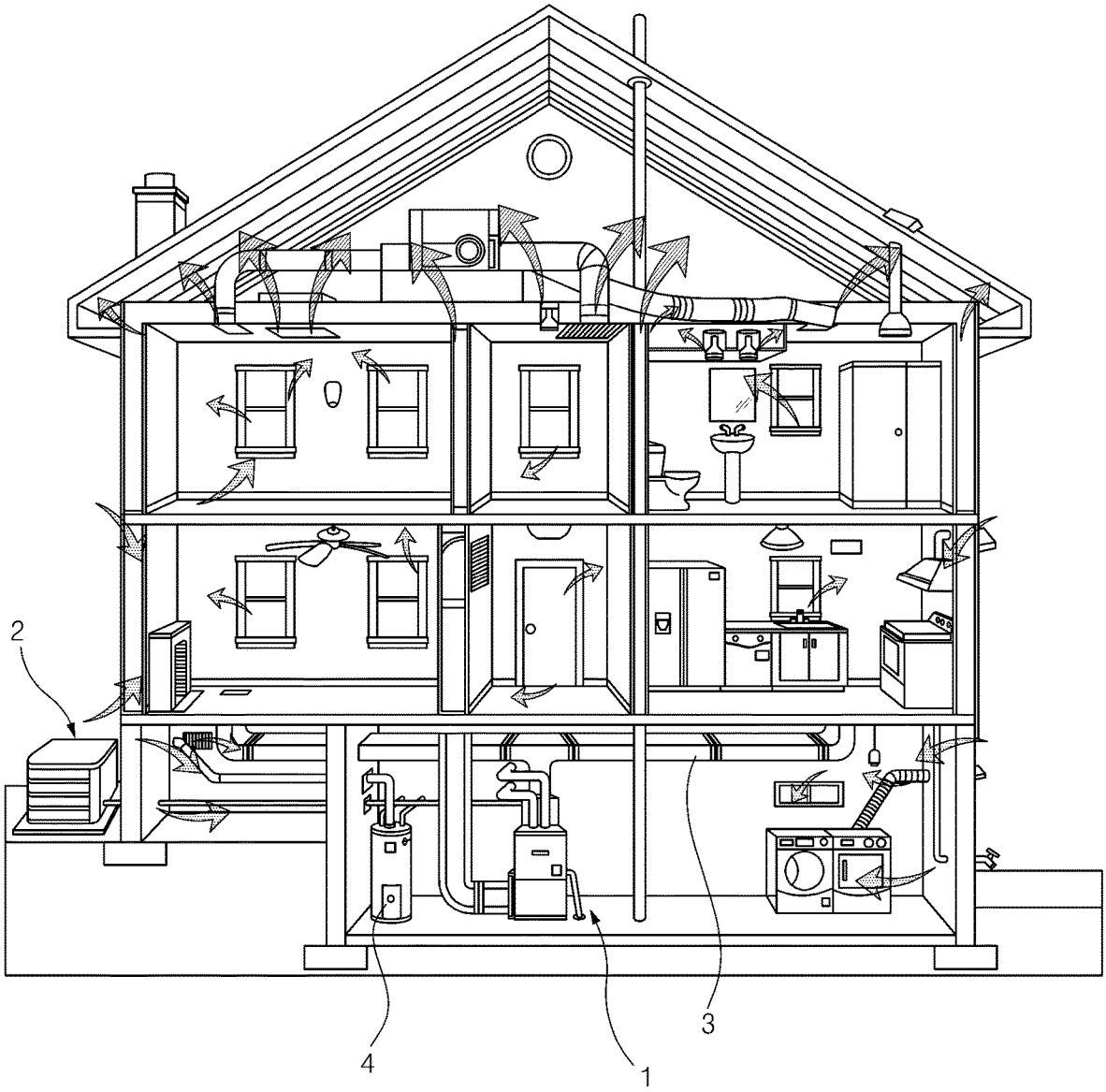
FIG. 1 is a view illustrating a heating system including an air heating apparatus according to one embodiment of the present disclosure.

Hereinafter, some embodiments of the present disclosure will be described in detail with reference to the exemplary drawings. In adding the reference numerals to the components of each drawing, it should be noted that the identical or equivalent component is designated by the identical numeral even when they are displayed on other drawings. Further, in describing the embodiment of the present disclosure, a detailed description of well-known features or functions will be ruled out in order not to unnecessarily obscure the gist of the present disclosure.

FIG. 1 is a view illustrating a heating system including an air heating apparatus according to one embodiment of the present disclosure.

Referring to FIG. 1, the heating system including the air heating apparatus according to one embodiment of the present disclosure may be installed in a house. The heating system may include the air heating apparatus 1 for heating air. The air heating apparatus 1 may be connected with a duct 3 connected to each room in the house and may perform heating by delivering the heated air to the room. The air may be introduced into the air heating apparatus 1 from outside the house, or may be returned to the air heating apparatus 1 through the room in the house. Although the air is able to be introduced into the air heating apparatus 1 from outside the house, the following description will be given under the assumption that the air is returned to the air heating apparatus 1.

In this specification, a front-rear direction, a left-right direction, and an up-down direction are referred to for convenience of description and may be perpendicular to one another. However, these directions are determined relative to the direction in which the air heating apparatus 1 is arranged. The up-down direction may not necessarily mean the vertical direction.

The heating system may further include a separate heater 4 to generate hot water and may have a condenser 2 as an outdoor unit. The condenser 2 may supply a refrigerant to the air heating apparatus 1 in summer to cause the supply of cool air through the air heating apparatus 1.

Figure 2:
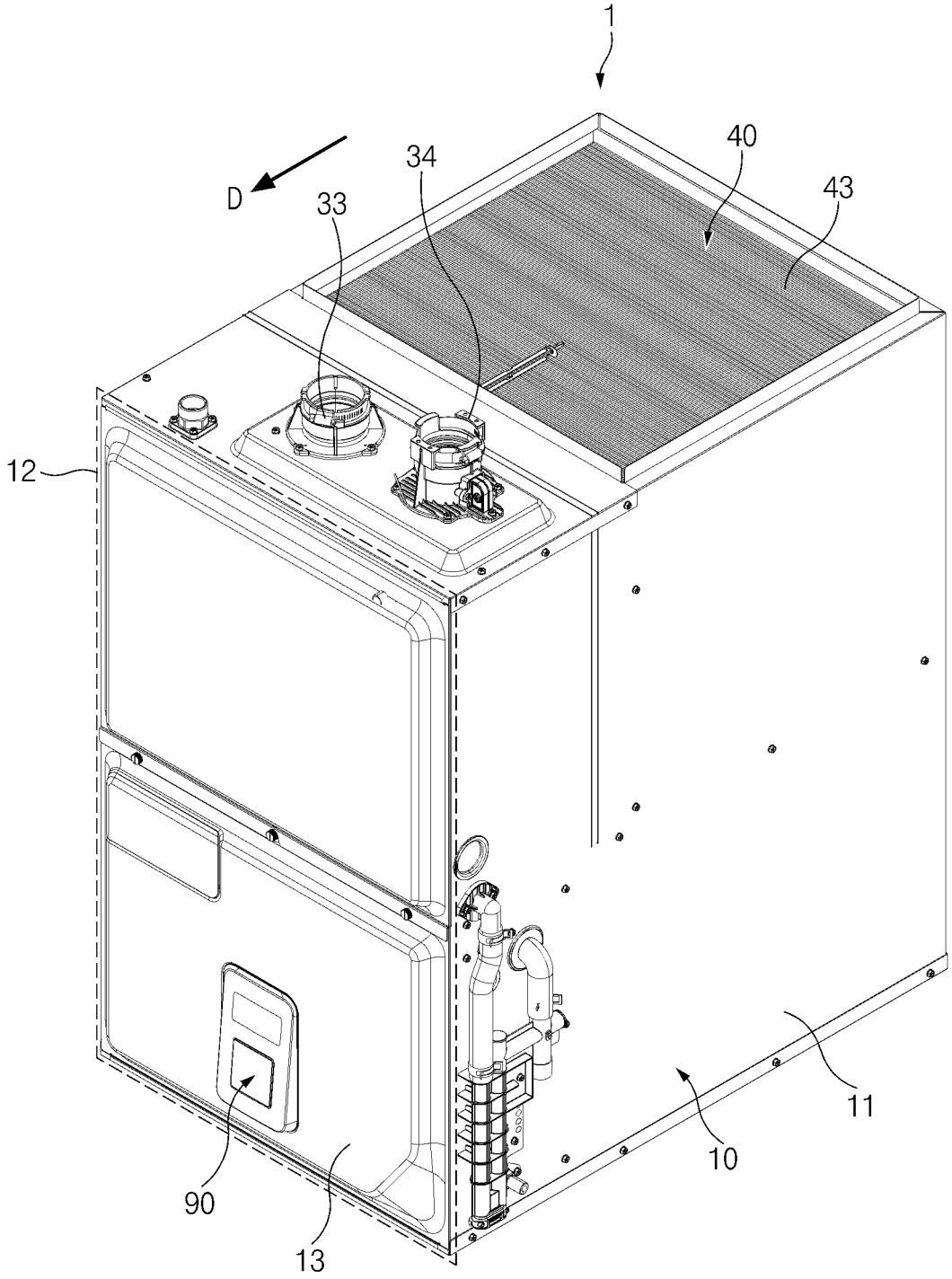
FIG. 2 is a perspective view illustrating the air heating apparatus according to one embodiment of the present disclosure.
Figure 3:
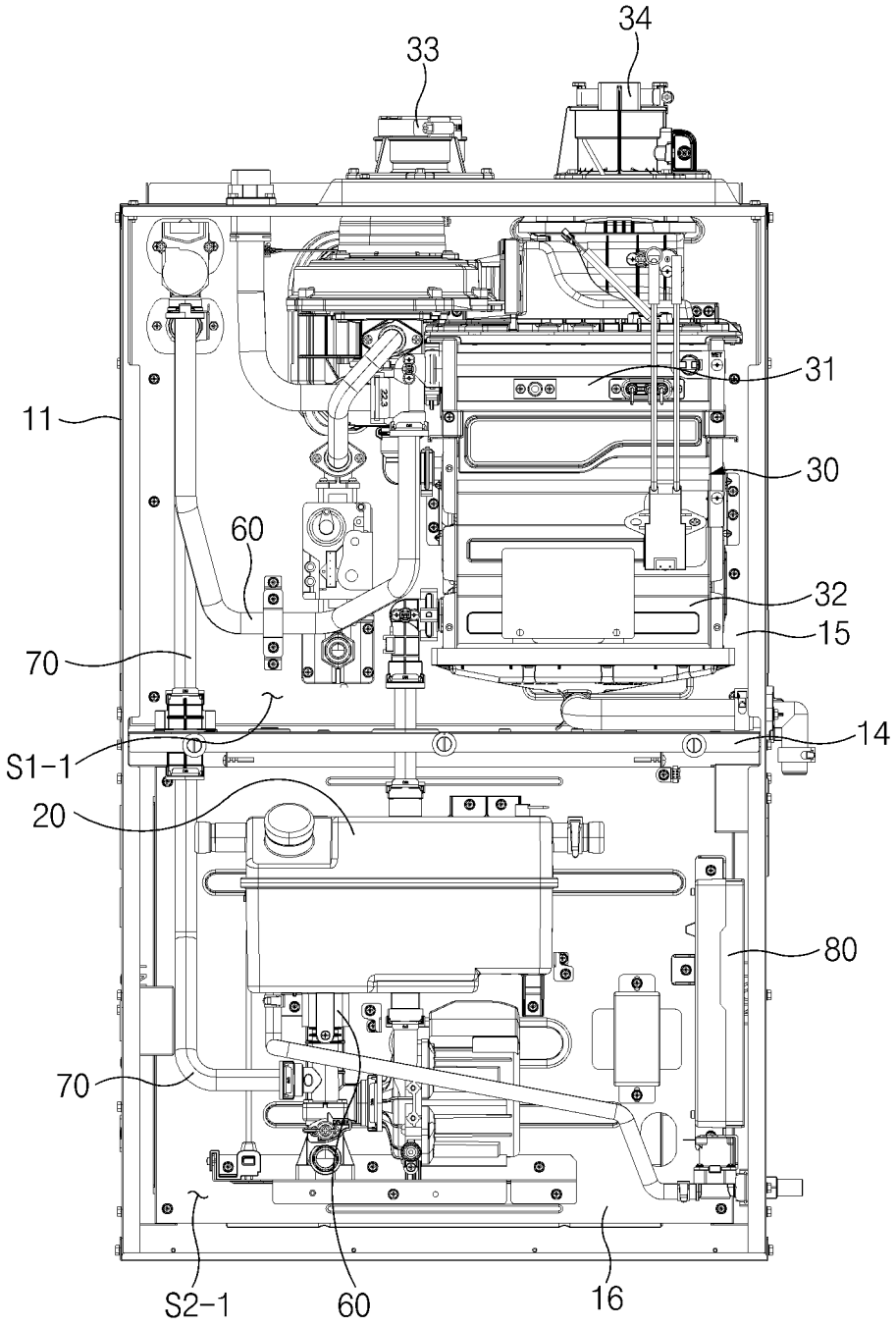
FIG. 3 is a view of the air heating apparatus according to one embodiment of the present disclosure as viewed from one side in a reference direction, where a first opening cover is removed from the air heating apparatus.
Figure 4:
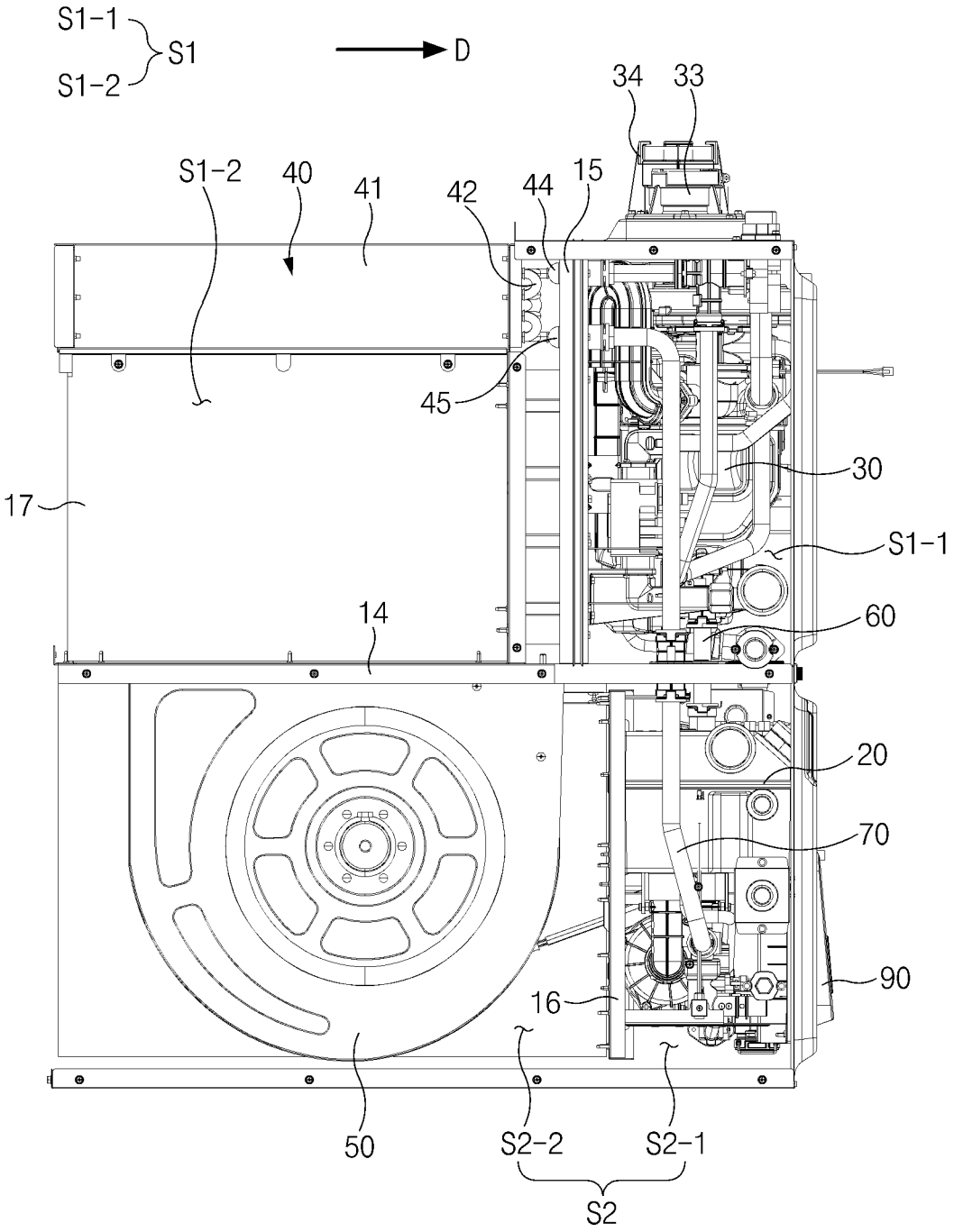
FIG. 4 is a view of the air heating apparatus according to one embodiment of the present disclosure as viewed from one side in a direction perpendicular to the up-down direction and the reference direction, where an outer box is removed from the air heating apparatus.
Figure 5:
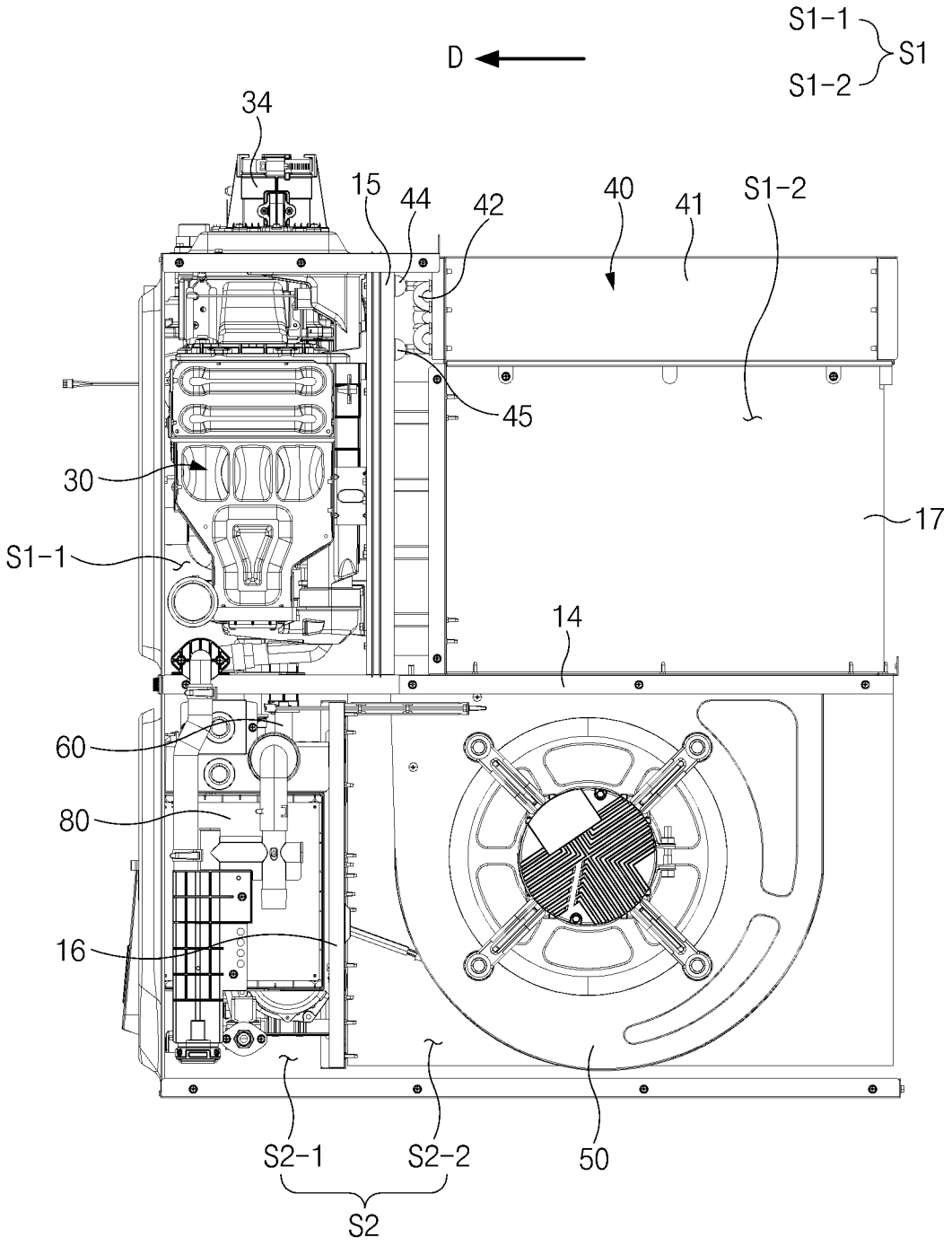
FIG. 5 is a view of the air heating apparatus according to one embodiment of the present disclosure as viewed from one side in a direction opposite to the direction perpendicular to the up-down direction and the reference direction.

First, basic components of the air heating apparatus according to one embodiment of the present disclosure will be described in detail with reference to the accompanying drawings. FIG. 2 is a perspective view illustrating the air heating apparatus according to one embodiment of the present disclosure. FIG. 3 is a view of the air heating apparatus according to one embodiment of the present disclosure as viewed from one side in a reference direction, where a first opening cover is removed from the air heating apparatus. FIG. 4 is a view of the air heating apparatus according to one embodiment of the present disclosure as viewed from one side in a direction perpendicular to the up-down direction and the reference direction, where an outer box is removed from the air heating apparatus. FIG. 5 is a view of the air heating apparatus according to one embodiment of the present disclosure as viewed from one side in a direction opposite to the direction perpendicular to the up-down direction and the reference direction. For reference, in each of the drawings, some components such as the outer box may be omitted for convenience of illustration.

Referring to the drawings, the air heating apparatus 1 according to one embodiment of the present disclosure may include a case 10, an expansion tank 20, a water heating device 30, a heating heat exchanger 40, and a fan 50. In brief overview of the overall air heating mechanism, the air heating apparatus 1 provides water stored in the expansion tank 20 to the water heating device 30, causes the water heating device 30 to heat the water, and sends the heated water to the heating heat exchanger 40. The heated water sent to the heating heat exchanger 40 heats up air supplied from the fan 50, and the heated air is delivered to each room. Hereinafter, the components will be described in more detail.

Case 10

The case 10 may have the expansion tank 20, the water heating device 30, the heating heat exchanger 40, and the fan 50 disposed therein. The case 10 may include the outer box 11, the first opening cover 13, a first partition wall 14, a second partition wall 15, and a third partition wall 16.

The outer box 11 may have a first opening 12 formed at one side thereof in the reference direction D that is a direction perpendicular to the up-down direction. For example, the reference direction D may be the front direction. The first opening cover 13 may be coupled to the outer box 11 and may cover the first opening 12 when coupled to the outer box 11. The first opening cover 13 may be separated from the outer box 11 for repair inside the air heating apparatus 1. For example, the first opening cover 13 may include an upper cover that covers an upper portion of the first opening 12 with respect to the first partition wall 14 to be described below and a lower cover that covers a lower portion of the first opening 12 with respect to the first partition wall 14. However, without being necessarily limited thereto, the first opening cover 13 may have a shape that covers the entire first opening 12.

The first partition wall 14 may be coupled to the outer box 11 and may extend in the reference direction D to divide the inside of the outer box 11 into a first partition space S1 and a second partition space S2.

The second partition wall 15 may be disposed perpendicular to the first partition wall 14 in the outer box 11 and may divide the first partition space S1 into a first-first partition space S1-1 and a first-second partition space S1-2. The second partition wall 15 may be separable from the inside of the outer box 11. This may mean that the second partition wall 15 is detachably coupled to the inside of the outer box 11.

The third partition wall 16 may be disposed perpendicular to the first partition wall 14 in the outer box 11 and may divide the second partition space S2 into a second-first partition space S2-1 and a second-second partition space S2-2. This may mean that the inside of the case 10 is divided into four spaces in a 2×2 form. The third partition wall 16 may be separable from the inside of the outer box 11. This may mean that the third partition wall 16 is detachably coupled to the inside of the outer box 11.

For example, the length of the first-first partition space S1-1 in the up-down direction may correspond to the length of the first-second partition space S1-2 in the up-down direction, and the length of the second-first partition space S2-1 in the up-down direction may correspond to the length of the second-second partition space S2-2 in the up-down direction. The expression "correspond to" used herein does not necessarily mean that the lengths are equal to each other, but may be construed as a concept including the case in which the lengths have a certain proportional relationship. For example, the ratio between the length of the first-first partition space S1-1 in the up-down direction and the length of the second-first partition space S2-1 in the up-down direction may be equal to the ratio between the length of the first-second partition space S1-2 in the up-down direction and the length of the second-second partition space S2-2 in the up-down direction. However, without being necessarily limited thereto, various modifications may be made according to needs such as the sizes and installation spaces of internal components.

As described above, the length of the first-first partition space S1-1 in the up-down direction may correspond to the length of the first-second partition space S1-2 in the up-down direction, and the length of the second-first partition space S2-1 in the up-down direction may correspond to the length of the second-second partition space S2-2 in the up-down direction. Accordingly, removal and mounting of each component may be facilitated, and thus ease of customer service, such as after-sales service, may be improved.

The length of the first-first partition space S1-1 in the reference direction D may be shorter than the length of the first-second partition space S1-2 in the reference direction D. The length of the second-first partition space S2-1 in the reference direction D may be shorter than the length of the second-second partition space S2-2 in the reference direction D. The length of the first-first partition space S1-1 in the reference direction D may correspond to the length of the second-first partition space S2-1 in the reference direction D. The length of the first-second partition space S1-2 in the reference direction D may correspond to the length of the second-second partition space S2-2 in the reference direction D.

The length of each space in the direction perpendicular to the up-down direction and the reference direction D is referred to as the width. The width of the first-first partition space S1-1 may be greater than or equal to the width of the first-second partition space S1-2. The width of the second-first partition space S2-1 may be greater than or equal to the width of the second-second partition space S2-2. The width of the first-first partition space S1-1 may correspond to the width of the second-first partition space S2-1. The width of the first-second partition space S1-2 may correspond to the width of the second-second partition space S2-2.

When the width of the first-first partition space S1-1 is greater than or equal to the width of the first-second partition space S1-2 and the width of the second-first partition space S2-1 is greater than or equal to the width of the second-second partition space S2-2, convenience in removing and mounting a product for user service may be increased.

For example, the first partition space S1 may be disposed above the second partition space S2. The water heating device 30 may be disposed in the first-first partition space S1-1. The heating heat exchanger 40 may be disposed in the first-second partition space S1-2. The expansion tank 20 may be disposed in the second-first partition space S2-1. The fan 50 may be disposed in the second-second partition space S2-2. To allow the air supplied from the fan 50 to be delivered to the heating heat exchanger 40, a passage through which the air passes may be formed in a portion of the first partition wall 14 that is located between the first-second partition space S1-2 and the second-second partition space S2-2.

Expansion Tank 20

The expansion tank 20 may store water. The water may be introduced from an external water source. The expansion tank 20 may be formed to accept a volume change depending on a change in the temperature of the water. The expansion tank 20 may be connected to a main passage 60. The main passage 60 may be a passage that connects the expansion tank 20, the water heating device 30, and the heating heat exchanger 40. That is, the water in the expansion tank 20 may be introduced from the expansion tank 20 into the heating heat exchanger 40 via the water heating device 30. Accordingly, the main passage 60 may penetrate the first partition wall 14.

The expansion tank 20 may accept volume expansion of the water flowing through the main passage 60. The expansion tank 20 may be of an open type.

In the state in which the expansion tank 20 is filled with the water, the pressure in the expansion tank 20 may be changed when temperature changes or when the water enters or exits the expansion tank 20. Accordingly, the water accommodated in the expansion tank 20 may be provided to other components along the main passage 60.

A water level sensor may be disposed in the expansion tank 20 to sense the water level in the expansion tank 20. The water level sensor may be connected with a controller 80.

Water Heating Device 30

The water heating device 30 is a component that heats introduced water and then releases the heated water. To heat the introduced water, the water heating device 30 may cause a combustion reaction and may transfer heat generated from the combustion reaction to the introduced water.

The water heating device 30 may include a burner 31 and a heat exchanger 32. The burner 31 causes the combustion reaction. The burner 31 may receive fuel and air and may cause the combustion reaction by forming a flame in a mixture of the fuel and the air using a spark plug. For this operation, the burner 31 may include a blower that blows out the air, a fuel nozzle that injects the fuel, and the spark plug that causes a spark for ignition.

The burner 31 may further include a mixing chamber and may cause the fuel and the air to be mixed with each other in the mixing chamber. Heat and combustion gas may be generated by the combustion reaction. The heat and the combustion gas may be transferred to the introduced water. The fuel may be natural gas containing methane and ethane that is used for power generation, or may be oil. However, the type of fuel is not limited thereto. The flame formed by the combustion reaction caused by the burner 31 may be located in an inner space of a combustion chamber under the burner 31. The combustion chamber may be a wet-type combustion chamber. For example, a water pipe through which water passes may be disposed on side surfaces of the combustion chamber in a form surrounding the side surfaces of the combustion chamber. In a process in which heat in the combustion chamber is radiated to the outside of the combustion chamber, some of the heat may be transferred to the water in the water pipe.

However, without being limited to the wet-type combustion chamber, the combustion chamber may have various modified examples including a dry-type combustion chamber.

The heat exchanger 32 is disposed to transfer heat generated from the burner 31 to the introduced water. The heat exchanger 32 may be disposed under the burner 31.

Meanwhile, the heat exchanger 32 may have an integrated heat exchanger structure. The integrated heat exchanger structure may refer to a heat exchanger structure in which different types of heat exchange mediums are distributed. Since the heat exchanger 32 has the integrated heat exchanger structure, the heat exchanger 32 may have a structure with a reduced overall height while maintaining the performance, when compared to a heat exchanger used in a general condensing boiler. Accordingly, although the internal structure of the air heating apparatus 1 is narrow, the overall height of the water heating device 30 may be decreased. Due to this, several components may be easily disposed inside the air heating apparatus 1, and the overall size of the air heating apparatus 1 may be made small.

The heat exchanger 32 may include a sensible heat exchanger and a latent heat exchanger. The sensible heat exchanger and the latent heat exchanger may be fin-tube type heat exchangers, each of which includes fins and tubes through which water flows, or may be plate-type heat exchangers, each of which is formed by stacking a plurality of plates. However, the types thereof are not limited thereto. The water introduced into the heat exchanger 32 may be heated while passing through the latent heat exchanger and the sensible heat exchanger in sequence.

When the sensible heat exchanger and the latent heat exchanger are implemented with the fin-tube type heat exchangers, the fins may be formed in a plate shape and may be penetrated by the tubes. The fins may be spaced apart from each other in the direction in which the tubes extend. The combustion gas may flow through the spaces between the fins and the spaces between the tubes, and the water may exchange heat with the combustion gas while flowing through the tubes.

In a cross-section obtained by cutting each of the tubes with a plane perpendicular to the extension direction of the tube, the inner space may have a long narrow hole shape extending in the up-down direction. The inner space of the tube may be formed such that the value obtained by dividing the height in the up-down direction in the above-described cross-section by the width in the front-rear direction perpendicular to the up-down direction is more than 2.

The sensible heat exchanger receives heat generated by the combustion reaction and heats the water flowing through the inside of the sensible heat exchanger. Accordingly, the sensible heat exchanger may be disposed adjacent to the burner 31. The sensible heat exchanger may not be blocked against the flame, and the combustion gas may pass through the sensible heat exchanger.

The latent heat exchanger heats the water flowing through the inside of the latent heat exchanger by using latent heat of the combustion gas generated by the combustion reaction. Since the latent heat exchanger uses the latent heat of the combustion gas, the latent heat exchanger transfers, to the water flowing through the inside of the latent heat exchanger, heat generated when moisture in the combustion gas is condensed. Accordingly, the latent heat exchanger may be disposed behind the sensible heat exchanger based on the flow direction of the combustion gas such that the combustion gas, the temperature of which is lowered due to the transfer of heat to the water in the sensible heat exchanger, reaches the latent heat exchanger and is condensed. The tubes included in the latent heat exchanger may be disposed in different positions in the flow direction of the combustion gas to form a plurality of rows.

The sensible heat exchanger and the latent heat exchanger may be disposed in-line with the main passage 60 such that the water is introduced into the sensible heat exchanger through the latent heat exchanger. Accordingly, after firstly heated in the latent heat exchanger, the water may be secondly heated in the sensible heat exchanger and may be delivered to the heating heat exchanger 40 to be described below.

The water heating device 30 may further include a sensible heat insulating pipe outside the sensible heat exchanger. The sensible heat insulating pipe is a pipe that makes direct or indirect contact with the sensible heat exchanger and through which heating water flows to perform heat insulation on the sensible heat exchanger.

In the water heating device 30, the burner 31, the sensible heat exchanger, and the latent heat exchanger may be disposed in sequence from top to bottom. Accordingly, the combustion gas may flow downward. However, the flow direction of the combustion gas is not limited thereto.

The heat exchanger 32 may include a heat exchange housing and may be configured in such a manner that the sensible heat exchanger and the latent heat exchanger are disposed in the heat exchange housing. The combustion gas may pass through the space in the heat exchange housing and may exchange heat with the water flowing through the tubes of each heat exchanger.

The area of a cross-section obtained by cutting the inner space of the heat exchange housing with a plane perpendicular to the flow direction of the combustion gas is referred to as a reference cross-sectional area. The heat exchange housing may include a tapered region in which the reference cross-sectional area decreases in the flow direction of the combustion gas and a section in which the reference cross-sectional area does not decease. The reference cross-sectional area at a downstream end of the heat exchange housing based on the flow direction of the combustion gas may be smaller than the reference cross-sectional area at an upstream end of the heat exchange housing based on the flow direction of the combustion gas. The reference cross-sectional area at an upstream end of the latent heat exchanger based on the flow direction of the combustion gas may be smaller than the reference cross-sectional area at a downstream end of the sensible heat exchanger based on the flow direction of the combustion gas. Accordingly, as compared with when the reference cross-sectional area is maintained, the degree to which the flow speed is reduced when the combustion gas flows from the sensible heat exchanger toward the latent heat exchanger may be reduced, and the combustion gas may push condensate located between the fins or between the tubes. Thus, the structure of the heat exchange housing may prevent the condensate from causing a stagnant flow of the combustion gas in the latent heat exchanger to decrease thermal efficiency. The fins of each heat exchanger may be formed according to the shape of the inner space of the above-described heat exchange housing.

The order in which the water flows from the heat exchanger 32 will be described. The water may be introduced into the latent heat exchanger of the heat exchanger 32. The water may condense water vapor of the combustion gas flowing around the latent heat exchanger and may be heated by latent heat generated in the condensation process. The water heated in the latent heat exchanger may be delivered to the sensible heat exchanger and may be heated in a manner of receiving heat generated by the combustion reaction. The water heated in the heat exchanger 32 may be delivered to the heating heat exchanger 40. The water delivered to the heating heat exchanger 40 may be cooled by transferring heat to air passing through the heating heat exchanger 40.

The heat exchange housing may include left and right side surfaces and flow passage cap plates that cover the left and right side surfaces. The flow passage cap plates are plates including flow passage caps that form inner spaces together with the left and right side surfaces by covering the left and right side surfaces of the heat exchange housing through which the tubes pass. The flow passage caps and the tubes may be fluidically connected with each other to form a passage through which the water flows in the heat exchanger 32. The passage formed in the heat exchanger 32 by the flow passage caps and the tubes may include a parallel section and a serial section.

An air inlet 33 for supplying outside air to the water heating device 30 may be formed through an upper sidewall of the case 10. The air introduced through the air inlet 33 may be provided to the burner 31 of the water heating device 30. The combustion gas generated by the combustion reaction in the water heating device 30 may be delivered to a gas outlet 34 formed through the upper sidewall of the case 10 through an exhaust duct and may be discharged to the outside. Since the combustion gas is located only in the water heating device 30 and discharged through the gas outlet 34, there is no risk that the combustion gas is mixed with air supplied to each room.

Heating Heat Exchanger 40

The heating heat exchanger 40 is a component for heat exchange between water and air. The heating heat exchanger 40 may receive the water and may conduct heat exchange between the air to be released for heating and the water.

The heating heat exchanger 40 may be disposed adjacent to the upper sidewall of the case 10. The heating heat exchanger 40 may include a heat exchange tube 42 through which the water heated by the water heating device 30 flows. The heat exchange tube 42 may be formed in a pipe shape such that the water flows through the heat exchange tube 42 and the air supplied by the fan 50 flows around the heat exchange tube 42. The heat exchange tube 42 may be configured to form a meandering passage in the front-rear direction and the left-right direction. The heat exchange tube 42 may be formed of a material including aluminum and copper.

Since the heat exchange tube 42 is formed of the above-described material and is configured such that the water flows through the heat exchange tube 42, the following effects may be expected. Unlike a pipe of a gas furnace in the related art that experiences excessive thermal expansion and contraction caused by combustion gas flowing through the pipe and air flowing around the pipe and is likely to suffer from cracking and combustion gas leakage, the heat exchange tube 42 may reduce the risk of cracking, and even though the heat exchange tube 42 is cracked, the combustion gas may not be leaked into the air, but only the water may be leaked out of the heat exchange tube 42. Accordingly, safety may be greatly enhanced. In addition, since the heat exchange between the water and the air is performed through the heat exchange tube 42 in the heating heat exchanger 40 of the present disclosure, the air may be heated while humidity is maintained, and thus a separate humidity control device is not required.

The heat exchange tube 42 may form a plurality of layers disposed in different positions in the up-down direction. In the present disclosure, the heat exchange tube 42 is illustrated as forming four layers. However, the number of layers is not limited thereto. In addition, the heat exchange tube 42 may be formed in a form in which the four layers are all connected in series, or may be formed in a form in which series connection and parallel connection are mixed.

The heat exchange tube 42 may include straight members extending in the front-rear direction and connecting members connecting the distal ends of the straight members adjacent to each other. The connecting members may include same-layer connecting members and different-layer connecting members. The straight members may be arranged in the left-right direction, and the same-layer connecting members may be disposed at the front and rear ends of the straight members and may connect the distal ends of the straight members adjacent to each other to form a passage. The different-layer connecting members may connect the distal ends of the straight members located in adjacent layers to form a passage. Each of the connecting members may be formed in the shape of "U".

The heating heat exchanger 40 may further include a distribution pipe 44. The distribution pipe 44 may receive the water from the water heating device 30 and may distribute the water to each layer constituted by the heat exchange tube 42. The distribution pipe 44 may include a distribution delivery pipe and a distribution head. The distribution delivery pipe may be connected with the main passage 60 and may receive the heated water through the heat exchanger 32, and the water may flow in the distribution head connected with the distribution delivery pipe. The distribution head may extend in the left-right direction and may be connected to the plurality of straight members. Accordingly, a parallel passage constituted by a plurality of partial passages having a common inlet and a common outlet may be formed by the distribution head. Here, the inlet of the parallel passage may be the distribution head. The entire passage formed by the heat exchange tube 42 may include a section constituted by the above-described parallel passage.

The straight members connected to the distribution head may be straight members located in the uppermost layer among the layers formed by the heat exchange tube 42. The water may be delivered to the uppermost layer of the heat exchange tube 42 and may flow to the lowermost layer along the layers formed by the heat exchange tube 42. In this process, the water may transfer heat to the air passing around the heat exchange tube. That is, in the heating heat exchanger 40, the air supplied by the fan 50 may flow in the upward direction, and the water may entirely move in the downward direction. Accordingly, the heating heat exchanger 40 may have a counter-flow structure.

The heating heat exchanger 40 may further include a collection pipe 45 that returns the water having transferred heat to the air to the water heating device 30. The collection pipe 45 may include a collection delivery pipe and a collection head. The heat exchange tube 42 may be connected to the collection head, and cooled water may be delivered to the collection head. The collection head may be connected with the collection delivery pipe and may allow the cooled water to be delivered to a recovery passage 70 connected to the collection delivery pipe. The collection head may extend in the left-right direction and may be connected to the plurality of straight members. Accordingly, the collection head may be the outlet of the parallel passage, and the parallel passage may end at the collection head. Thus, the water may be collected in the collection head. The straight members connected to the collection head may be straight members located in the lowermost layer among the layers formed by the heat exchange tube 42.

The heating heat exchanger 40 may have a plurality of heat transfer fins 43 that cross the heat exchange tube 42 and that are penetrated by the heat exchange tube 42. The heat transfer fins 43 may be formed in a plate shape perpendicular to the front-rear direction and may be arranged in the front-rear direction. The heat transfer fins 43 may more easily transfer heat of the water flowing through the heat exchange tube 42 to ambient air. Air may pass between the heat exchange tube 42 and the heat transfer fins 43 in the upward direction. The heat transfer fins 43 and the heat exchange tube 42 may be fixed by a heating heat exchange housing 41. The heat transfer fins 43 may be disposed in the heating heat exchange housing 41. The heating heat exchange housing 41 may be fixed to the case 10.

Fan 50

The fan 50 supplies air to the heating heat exchanger 40. To supply the air upward and cause the air to pass through the heating heat exchanger 40, the fan 50 may be disposed under the heating heat exchanger 40, and the outlet of the fan 50 through which the air is released may be disposed to face upward. The fan 50 may include components, such as a motor and blades, and may be electrically connected with the controller 80. As the fan 50 is electrically controlled to operate, the motor may rotate the blades to supply the air. The fan 50 may include an impeller to forcibly feed the air.

The length of the fan 50 in the reference direction D may be shorter than the length of the second-first partition space S2-1 in the reference direction D. In addition, the length of the fan 50 in the up-down direction may be shorter than the length of the second-first partition space S2-1 in the up-down direction. An air supply space that is an empty space may be formed between the fan 50 and the heating heat exchanger 40 in the inner space of the case 10.

An air circulation process from the fan 50 will be described. Air introduced into the fan 50 may be supplied upward. The supplied air may pass through the heating heat exchanger 40. The air, while passing through the heating heat exchanger 40, may receive heat from water flowing through the heating heat exchanger 40 and may be heated. The heated air may be released outside the case 10 and may be fed into each room of the house through the duct 3. The air fed into each room or cool air introduced into the house from the outside may be introduced into the case 10 again and may enter the inlet of the fan 50.

Main Passage 60 and Recovery Passage 70

Hereinafter, the main passage 60 and the recovery passage 70 that connect the components will be described in detail. The main passage 60 may refer to a passage that connects the expansion tank 20, the water heating device 30, and the heating heat exchanger 40. The recovery passage 70 may refer to a passage that connects the heating heat exchanger 40 and the main passage 60 and guides water introduced into the heating heat exchanger 40 to the main passage 60. Accordingly, the recovery passage 70 may penetrate the first partition wall 14. Meanwhile, the term "passage" used herein may mean that the insides of components through which fluid is able to flow are connected by pipes or hoses, through which the fluid is able to flow, to form a path along which the fluid flows.

Controller 80

The controller 80 may control the temperature of water that passes through the heating heat exchanger 40 along the main passage 60 and returns to the water heating device 30. The controller 80 may include a processor and a memory. The processor is a component that includes an element capable of logic operation of executing a control command. The processor may include a central processing unit (CPU). The processor may be connected to various types of components and may transfer signals depending on control commands to the respective components to perform control. The processor may be connected to various sensors or acquisition devices and may receive obtained information in a signal form. Accordingly, in one embodiment of the present disclosure, the processor may be electrically connected to various components included in the air heating apparatus 1. The processor may be electrically connected with the components. The processor may be wiredly connected to the components, or may additionally have a communication module capable of wireless communication to communicate with the components.

The processor may be electrically connected with the components of the integrated air heating apparatus 1 according to one embodiment of the present disclosure and may perform an operation using received information and transfer control signals. Accordingly, the processor may control the components in optimal states, and the components may automatically operate in conjunction with one another. In addition, due to integrated interlocking control of the processor, as will be described below, the processor may obtain, integrate, and control information obtained from circulating water and air or control data in real time. Accordingly, the processor may maintain even efficiency and may automatically provide optimum settings suitable for the entire system.

The control commands executed by the processor may be stored in the memory and may be used. The memory may be a device such as a hard disk drive (HDD), a solid state drive (SSD), a server, a volatile medium, a non-volatile medium, or the like, but the type thereof is not limited thereto. In addition, data required for the processor to perform tasks may be additionally stored in the memory.

The controller 80 may be disposed in the second-first partition space S2-1. A panel assembly 90 including a display, a button, and the like that a user manipulates to operate the controller 80 may be disposed on the first opening cover 13.

The controller 80 may control the temperature of returned water by controlling the flow rate of water flowing in the main passage 60. When the flow rate of the water flowing in the main passage 60 is controlled to be decreased, the water may flow in the heating heat exchanger 40 for a longer period of time than when not and may transfer a large amount of heat to air, and thus the temperature of the returned water may be decreased. In contrast, when the flow rate of the water flowing in the main passage 60 is controlled to be increased, the temperature of the returned water may be increased than when not.

The controller 80 may be electrically connected with the burner 31 and may control the burner 31 to adjust the amount of heat transferred to water. To mix fuel and air and use the mixture in combustion, the burner 31 may include the blower that blows out air, and the controller 80 may adjust the operating speed of the blower to adjust the flow rate of air supplied to a portion where a flame is generated.

As the flow rate of air is adjusted, the amount of heat generated by the combustion reaction in the water heating device 30 may be adjusted. Accordingly, the air heating apparatus 1 according to one embodiment of the present disclosure may have a high turn-down ratio of 6:1 to 10:1. Thus, the air heating apparatus 1 may maintain constant efficiency by appropriately adjusting the amount of heat or the flow rate of water according to operating situations with different loads, such as low-load operation and high-load operation.

Meanwhile, an external interlocking controller may be additionally disposed in the second-first partition space S2-1. The external interlocking controller may be disposed adjacent to the first opening cover 13 of the case 10. The external interlocking controller may exchange data with devices (e.g., a thermostat in the house) located outside the air heating apparatus 1. The external interlocking controller may transfer data obtained from the devices located outside the air heating apparatus 1 to the controller 80. The controller 80 may perform the above-described controls, based on the data transferred from the external interlocking controller.

Air Leak Prevention Structure

Figure 6:
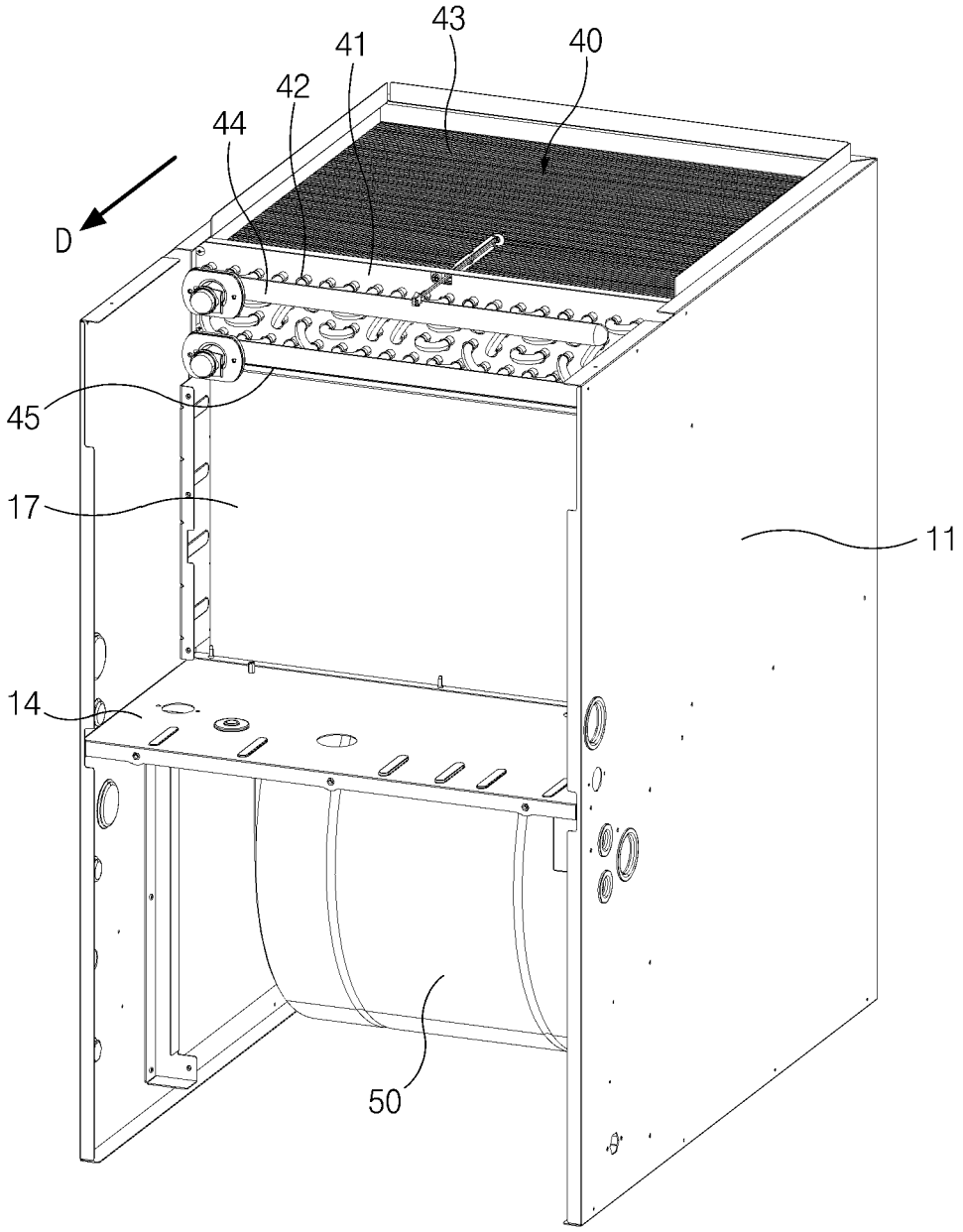
FIG. 6 is a perspective view illustrating a heating heat exchanger and a fan of the air heating apparatus according to one embodiment of the present disclosure.
Figure 7:
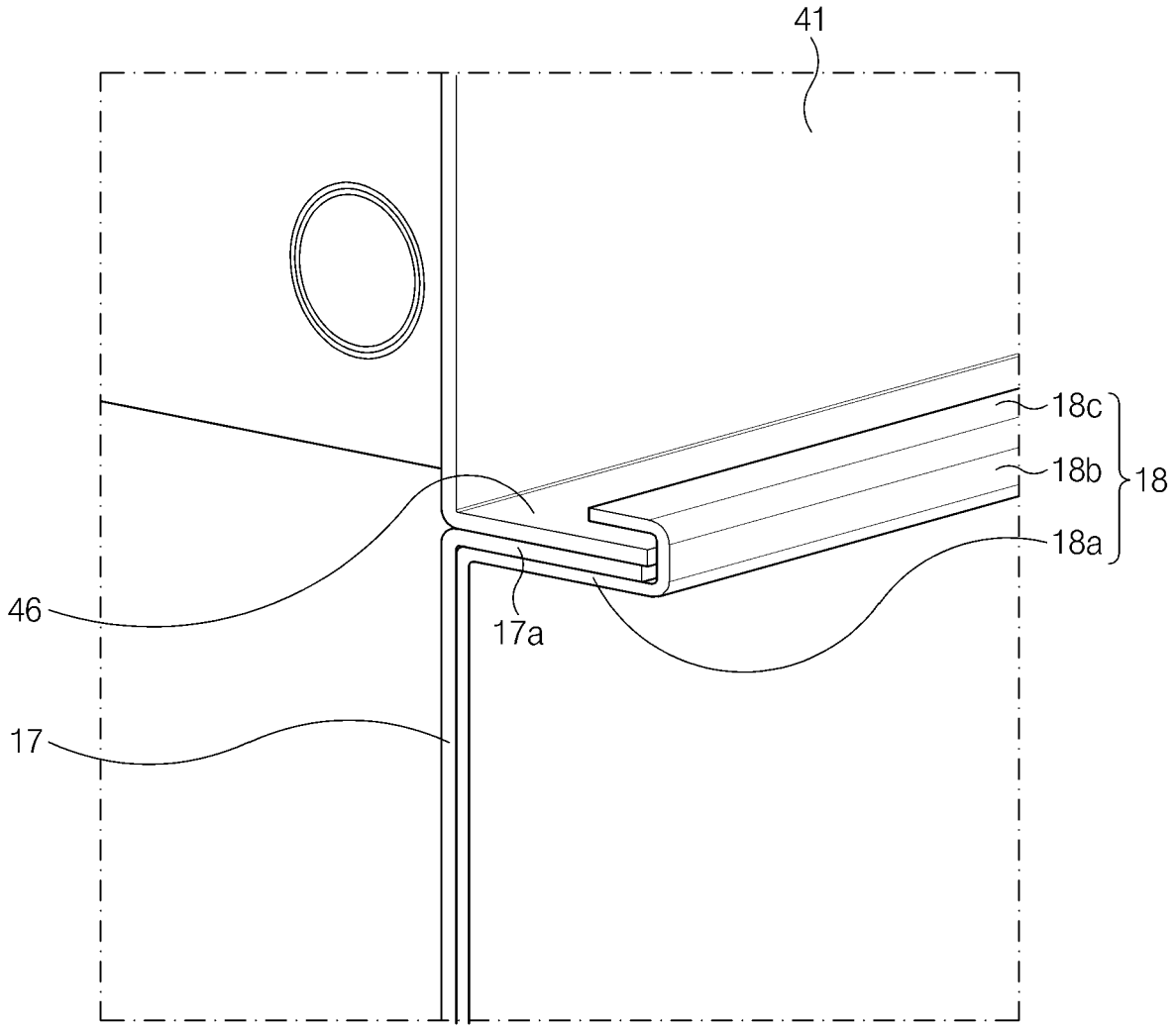
FIG. 7 is an enlarged view illustrating a guide member.
Figure 8:
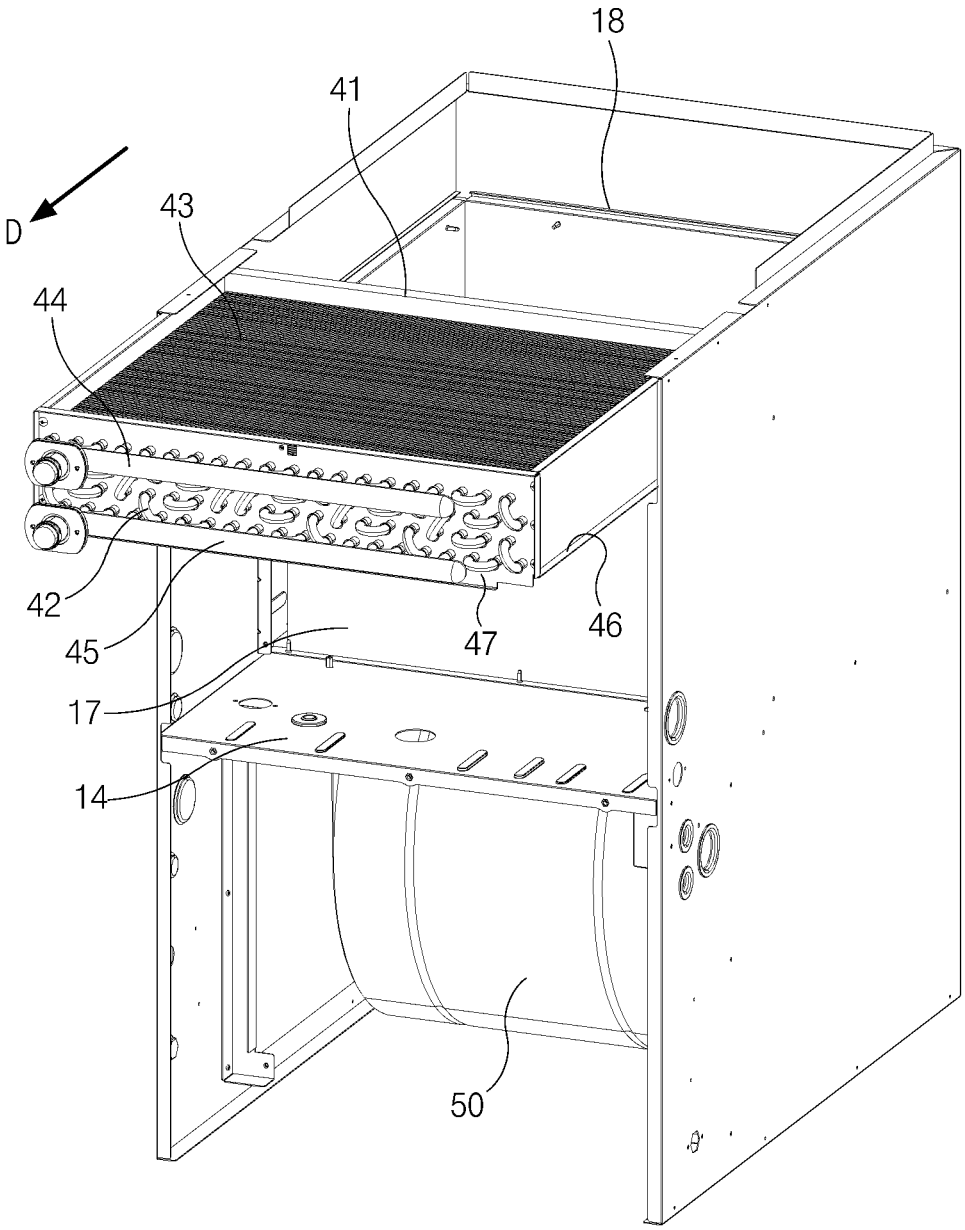
FIGS. 8 and 9 are views sequentially illustrating an assembly process of the heating heat exchanger.
Figure 9:
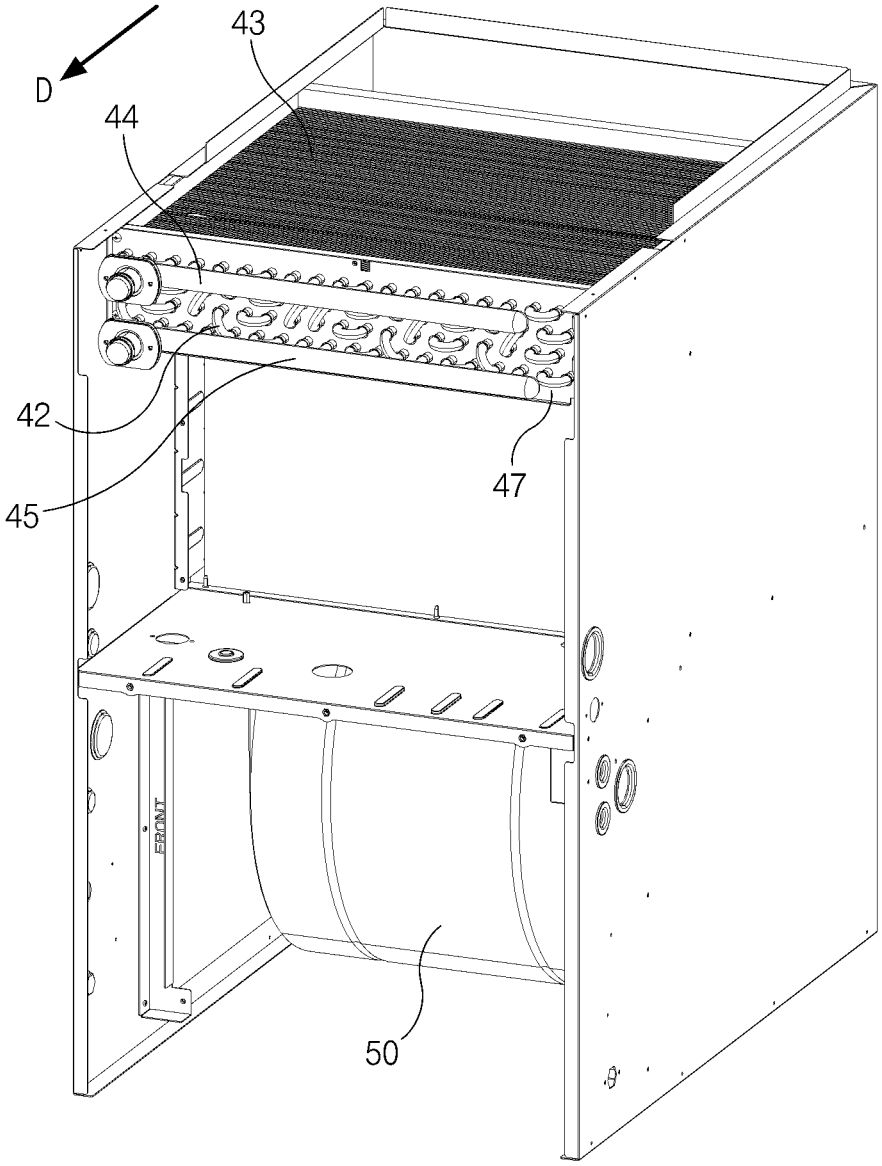
Figure 10:
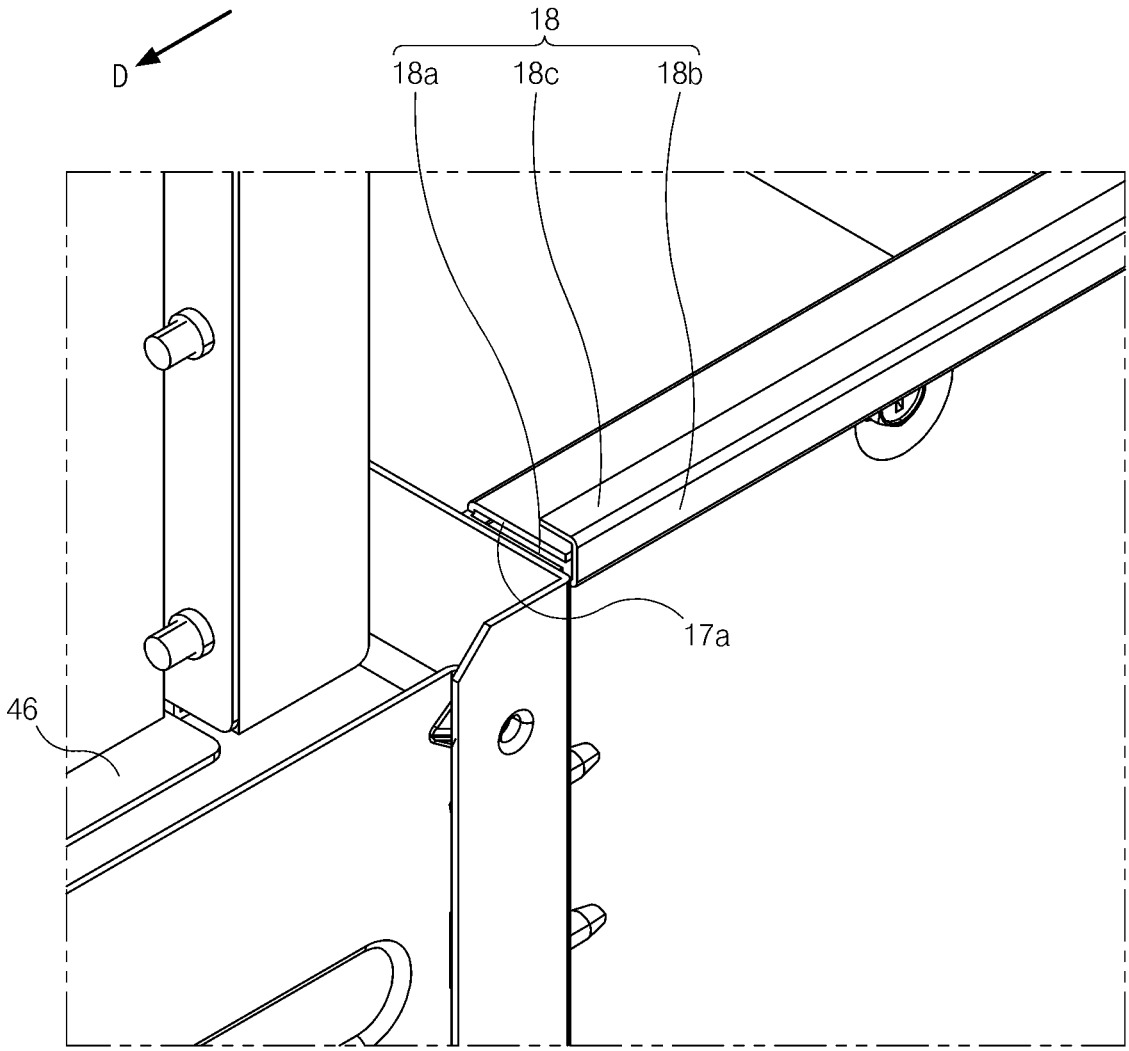
FIG. 10 is an enlarged view illustrating a situation right before the guide member and an insertion member are engaged with each other.
Figure 11:
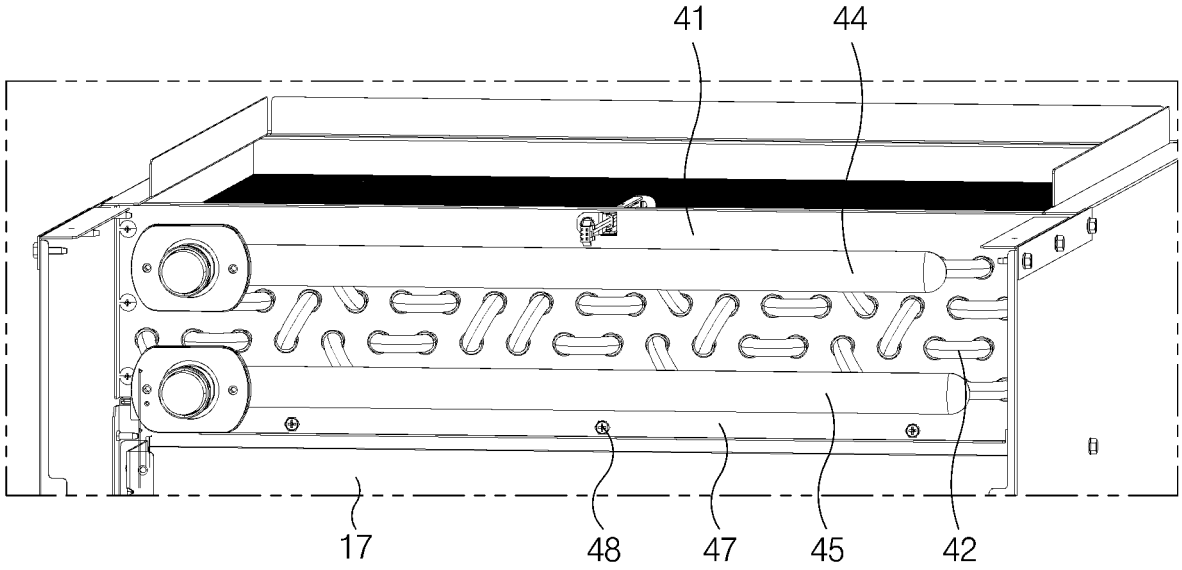
FIG. 11 is a view of the heating heat exchanger as viewed in the reference direction.

FIG. 6 is a perspective view illustrating the heating heat exchanger and the fan of the air heating apparatus according to one embodiment of the present disclosure. FIG. 7 is an enlarged view illustrating a guide member. FIGS. 8 and 9 are views sequentially illustrating an assembly process of the heating heat exchanger. FIG. 10 is an enlarged view illustrating a situation right before the guide member and an insertion member are engaged with each other. FIG. 11 is a view of the heating heat exchanger as viewed in the reference direction.

Hereinafter, the air leak prevention structure will be described in detail with reference to FIGS. 6 to 11.

The case 10 of the air heating apparatus 1 according to one embodiment of the present disclosure may include an air guide 17. The air guide 17 may be seated on the upper side of the first partition wall 14 and may have a shape that is fluidically connected with a communicating hole formed in the first partition wall 14 and that extends upward. For example, the air guide 17 may be formed in a rectangular prism shape and may have an empty space therein.

The heating heat exchanger 40 may be disposed above the air guide 17 in the first partition space S1. The fan 50 may be disposed in the second partition space S2 below the air guide 17. The air guide 17 may serve to guide the air supplied by the fan 50 toward the heating heat exchanger 40.

The guide member 18 may be coupled to the outside of the upper end of the air guide 17. The guide member 18 may guide sliding of the heating heat exchanger 40 in the reference direction D and the direction opposite to the reference direction D. That is, the heating heat exchanger 40 may have a structure engaged with the guide member 18.

For example, the heating heat exchanger 40 may further include the insertion member 46. The insertion member 46 may protrude outward from the heating heat exchange housing 41 and may be formed at a position corresponding to the guide member 18. The insertion member 46 may be inserted into the guide member 18. The insertion member 46 may be formed on the lower end portion of the heating heat exchange housing 41.

The guide member 18 may include a first guide part 18*a* and a second guide part 18*b*. The first guide part 18*a* may extend to the outside of the air guide 17. Here, the outside of the air guide 17 may refer to a side away from the air guide 17 in a direction perpendicular to the up-down direction with respect to a wall constituting the air guide 17. The second guide part 18*b* may extend upward from the outer end portion of the first guide part 18*a*. That is, the shape in which the first guide part 18*a* and the second guide part 18*b* are connected may be close to the shape of "L" as a whole.

As illustrated in FIG. 7, the air guide 17 may include a seating part 17*a* seated on the first guide part 18*a*. However, without being necessarily limited thereto, the guide member 18 may be coupled to the air guide 17 without the seating part 17*a*.

The guide member 18 may further include a third guide part 18*c*. The third guide part 18*c* may extend from the upper end portion of the second guide part 18*b* toward the air guide 17. The shape in which the first guide part 18*a*, the second guide part 18*b*, and the third guide part 18*c* are all connected may be similar to the shape obtained by rotating a U-shape by 90 degrees.

When the insertion member 46 slides while being guided by the guide member 18, the insertion member 46 may be seated on the first guide part 18*a* and may be disposed below the third guide part 18*c*. When the insertion member 46 is seated on the first guide part 18*a*, this may mean that the insertion member 46 is directly or indirectly seated on the first guide part 18*a*. For example, when the seating part 17*a* is disposed on the first guide part 18*a*, the insertion member 46 may be seated to make contact with the upper side of the seating part 17*a*. However, when the seating part 17*a* is not formed, the insertion member 46 may be seated to make contact with the upper side of the first guide part 18*a*.

Since the insertion member 46 is seated on the first guide part 18*a* and is disposed below the third guide part 18*c*, the heating heat exchanger 40 may be prevented from moving in the up-down direction when the heating heat exchanger 40 is assembled and disassembled, and thus it may be advantageous for guiding the movement of the heating heat exchanger 40.

The insertion member 46 may be seated on the first guide part 18*a* and may be disposed adjacent to the second guide part 18*b*. Since the insertion member 46 has this shape, a possibility that air leaks outside the air guide 17 may be reduced.

The guide member 18 may be formed on one side of the air guide 17 that faces in a direction perpendicular to the up-down direction and the reference direction D. When the reference direction D is the front direction, the direction may refer to one of the left direction and the right direction. Since the guide member 18 is formed on the side of the air guide 17 that faces in the direction perpendicular to the up-down direction and the reference direction D, the guide member 18 may guide the heating heat exchanger 40 in the reference direction D and the direction opposite to the reference direction D.

In addition, the guide member 18 may be additionally formed on one side of the air guide 17 that faces in the direction opposite to the reference direction D. The guide member 18 formed on the side of the air guide 17 that faces in the direction opposite to the reference direction D may serve to support the heating heat exchanger 40 in the upward direction and may serve to prevent leakage of air supplied from the fan.

That is, the guide member 18 may be formed on the left and right sides of the air guide 17 and may be formed on the side of the air guide 17 that faces in the direction opposite to the reference direction D. In summary, the guide member 18 may be formed on three sides of the air guide 17 other than the side facing in the reference direction D.

Meanwhile, the heating heat exchanger 40 may have an overlapping region 47. The overlapping region 47, when viewed in the reference direction D, may be a region overlapping the upper end portion of the side of the air guide 17 that faces in the reference direction D. The overlapping region 47 may be a region for fixing the position of the heating heat exchanger 40 to the air guide 17. For example, a fastening member 48, such as a screw, may be disposed in the overlapping region 47. The fastening member 48 may fasten the air guide 17 and the heating heat exchanger 40.

Hereinafter, a process of assembling and disassembling the heating heat exchanger 40 will be described in detail based on the above-described contents. Basically, the disassembly process may be a reverse process of the assembly process. The assembly process may be understood as changing the heating heat exchanger 40 from the state of FIG. 8 to the state of FIG. 6 through the state of FIG. 9.

First, the heating heat exchanger 40 is moved in the direction opposite to the reference direction D such that the heating heat exchanger 40 is located above the air guide 17. At this time, the insertion member 46 of the heating heat exchanger 40 is seated on the first guide part 18*a* and located below the third guide part 18*c*.

Continuously, the heating heat exchanger 40 is moved in the direction opposite to the reference direction D. At this time, the movement of the heating heat exchanger 40 in the direction opposite to the reference direction D may be guided because the guide member 18 is engaged with the insertion member 46.

Finally, when the heating heat exchanger 40 is disposed above the air guide 17, the overlapping region 47 and the air guide 17 are connected by fastening the fastening member 48 to the overlapping region 47.

According to the present disclosure, the guide structure may be formed on the air guide that guides air supplied by the fan to the heat exchanger, and the heat exchanger may be engaged with the guide structure. Accordingly, an air leak may be prevented, and the assembly performance of the heat exchanger may be improved.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims. Therefore, the exemplary embodiments of the present disclosure are provided to explain the spirit and scope of the present disclosure, but not to limit them, so that the spirit and scope of the present disclosure is not limited by the embodiments. The scope of the present disclosure should be construed on the basis of the accompanying claims, and all the technical ideas within the scope equivalent to the claims should be included in the scope of the present disclosure.

What is claimed is:

1. An air heating apparatus comprising:

an expansion tank configured to store water;

a water heating device configured to receive heat from combustion gas generated by a combustion reaction and heat the water;

a heating heat exchanger configured to receive the water heated by the water heating device and conduct heat exchange between air to be released for heating and the water;

a fan configured to supply the air to the heating heat exchanger; and a case in which the water heating device, the expansion tank, the heating heat exchanger, and the fan are disposed, wherein the case includes:

an outer box;

a first partition wall coupled to the outer box and configured to extend in a reference direction perpendicular to an up-down direction to divide the inside of the outer box into a first partition space and a second partition space; and an air guide seated on an upper side of the first partition wall and fluidically connected with a communicating hole formed in the first partition wall, the air guide being configured to extend upward, wherein the first partition space is located above the second partition space, wherein the heating heat exchanger is disposed above the air guide in the first partition space, wherein the fan is disposed in the second partition space below the air guide, and wherein a guide member is coupled to the outside of an upper end of the air guide to guide sliding of the heating heat exchanger in the reference direction.

2. The air heating apparatus of claim 1, wherein the heating heat exchanger includes:

a heating heat exchange housing; and an insertion member configured to protrude outward from the heating heat exchange housing and formed at a position corresponding to the guide member, the insertion member being inserted into the guide member.

3. The air heating apparatus of claim 2, wherein the guide member includes:

a first guide part configured to extend to the outside of the air guide; and a second guide part configured to extend upward from an outer end portion of the first guide part.

4. The air heating apparatus of claim 3, wherein the guide member further includes a third guide part configured to extend from an upper end portion of the second guide part toward the air guide.

5. The air heating apparatus of claim 4, wherein the insertion member is seated on the first guide part and disposed below the third guide part when the insertion member slides while being guided by the guide member.

6. The air heating apparatus of claim 1, wherein the guide member is formed on one side of the air guide configured to face in a direction perpendicular to the up-down direction and the reference direction.

7. The air heating apparatus of claim 1, wherein the guide member is formed on one side of the air guide configured to face in a direction opposite to the reference direction.

8. The air heating apparatus of claim 1, where the heating heat exchanger, when viewed in the reference direction, has an overlapping region configured to overlap an upper end portion of a side of the air guide in the reference direction.

9. The air heating apparatus of claim 2, wherein the insertion member is formed on a lower end portion of the heating heat exchange housing.

* * * * *